US011192183B2

(12) United States Patent
Katoh et al.

(10) Patent No.: US 11,192,183 B2
(45) Date of Patent: Dec. 7, 2021

(54) METHOD FOR MANUFACTURING POWDER MAGNETIC CORE

(71) Applicant: HITACHI METALS, LTD., Tokyo (JP)

(72) Inventors: Tetsuroh Katoh, Minato-ku (JP); Kazunori Nishimura, Minato-ku (JP); Shin Noguchi, Minato-ku (JP)

(73) Assignee: HITACHI METALS, LTD., Tokyo (JP)

( * ) Notice: Subject to any disclaimer, the term of this patent is extended or adjusted under 35 U.S.C. 154(b) by 880 days.

(21) Appl. No.: 15/759,550

(22) PCT Filed: Sep. 16, 2016

(86) PCT No.: PCT/JP2016/077478
§ 371 (c)(1),
(2) Date: Mar. 13, 2018

(87) PCT Pub. No.: WO2017/047764
PCT Pub. Date: Mar. 23, 2017

(65) Prior Publication Data

US 2020/0222986 A1 Jul. 16, 2020

(30) Foreign Application Priority Data

Sep. 16, 2015 (JP) ..... JP2015-182757

(51) Int. Cl.
*B22F 3/24* (2006.01)
*H01F 41/02* (2006.01)
(Continued)

(52) U.S. Cl.
CPC ..... *B22F 3/24* (2013.01); *B22F 1/02* (2013.01); *C22C 38/06* (2013.01); *C22C 38/18* (2013.01);
(Continued)

(58) Field of Classification Search
None
See application file for complete search history.

(56) References Cited

U.S. PATENT DOCUMENTS 10,008,324 B2 * 6/2018 Nishio ..... H01F 41/02
10,176,912 B2 * 1/2019 Nishimura ..... H01F 1/24
(Continued)

FOREIGN PATENT DOCUMENTS

EP 2 562 771 A1 2/2013
JP 2006-229203 A 8/2006
(Continued)

OTHER PUBLICATIONS

Communication dated Jan. 17, 2020, from the European Patent Office in application No. 16846635.7.
(Continued)

*Primary Examiner* — Anthony J Zimmer
*Assistant Examiner* — Anthony M Liang
(74) *Attorney, Agent, or Firm* — Sughrue Mion, PLLC

(57) ABSTRACT

A powder magnetic core manufacturing method includes: a first step of mixing a binder with a soft magnetic material powder containing Fe-M (M: Al or Cr)-based alloy particles on which an insulating layer is formed; a second step of filling a pressing die with a mixture obtained through the first step, subjecting the mixture to pressing to obtain a green compact, and slidingly demolding the green compact from the pressing die; a third step of processing the green compact after the second step and removing expansion deformed matter of the alloy particles present in a region of pressing flaws formed on a surface of the green compact during the slidingly demolding; and a fourth step of subjecting the green compact after the third step to heat treatment to
(Continued)

oxidize surfaces of the Fe-M (M: Al or Cr)-based alloy particles at high temperature, so that the oxide phase is formed.

3 Claims, 9 Drawing Sheets

(51) Int. Cl.

| | |
|---|---|
| ***H01F 1/147*** | (2006.01) |
| ***B22F 1/02*** | (2006.01) |
| ***C22C 38/18*** | (2006.01) |
| ***C22C 38/06*** | (2006.01) |

(52) U.S. Cl.
CPC ..... *H01F 1/147* (2013.01); *H01F 41/0246* (2013.01); *B22F 2301/35* (2013.01); *B22F 2998/10* (2013.01); *C22C 2202/02* (2013.01)

(56) References Cited

U.S. PATENT DOCUMENTS

| | | | | |
|---|---|---|---|---|
| 10,236,110 | B2 * | 3/2019 | Nishimura | C22C 38/28 |
| 10,354,790 | B2 * | 7/2019 | Nishimura | C22C 38/00 |
| 10,573,441 | B2 * | 2/2020 | Noguchi | B22F 5/10 |
| 2015/0332850 | A1 | 11/2015 | Nishio et al. | |
| 2016/0336104 | A1 | 11/2016 | Noguchi et al. | |

FOREIGN PATENT DOCUMENTS

| | | | | | |
|---|---|---|---|---|---|
| JP | 2011-181654 | A | | 9/2011 | |
| JP | 2012-238832 | A | | 12/2012 | |
| JP | 2013-84701 | A | | 5/2013 | |
| JP | 2013-131676 | A | | 7/2013 | |
| JP | 2014-120742 | A | | 6/2014 | |
| JP | 2014120742 | A | * | 6/2014 | |
| JP | 5626672 | B1 | | 11/2014 | |
| WO | WO-2014112483 | A1 | * | 7/2014 | C22C 38/18 |
| WO | 2015/108059 | A1 | | 7/2015 | |

OTHER PUBLICATIONS

Extended European Search Report dated Feb. 27, 2019 issued by the European Patent Office in counterpart application No. 16846635.7.
Communication dated Jun. 9, 2020, issued by the European Patent Office in application No. 16 846 635.7.
Translation of International Preliminary Report on Patentability dated Mar. 29, 2018, in counterpart International Application No. PCT/JP2016/077478.
International Search Report for PCT/JP2016/077478, dated Nov. 29, 2016.
Communication dated Sep. 30, 2020 from the Japanese Patent Office in Application No. 2017-540013.
Decision of Rejection dated Apr. 2, 2021 from the China National Intellectual Property Administration in CN Application No. 201680053890.X.
Decision of Refusal dated Jan. 28, 2021 from the Japanese Patent Office in Application No. 2017-540013.

* cited by examiner

Processed surface

Electron microscope image

Iron Ka1

Aluminum Ka1

Chromium Ka1

Oxygen Ka1

METHOD FOR MANUFACTURING POWDER MAGNETIC CORE

CROSS REFERENCE TO RELATED APPLICATIONS

This application is a National Stage of International Application No. PCT/JP2016/077478 filed Sep. 16, 2016, claiming priority based on Japanese Patent Application No. 2015-182757 filed Sep. 16, 2015.

TECHNICAL FIELD

The present invention relates to a method for manufacturing a powder magnetic core constituted using an Fe-based soft magnetic material powder.

BACKGROUND ART

Conventionally, coil components such as inductors, transformers, and chokes are used in various applications such as home electric appliances, industrial apparatuses, and vehicles. The coil component is composed of a powder magnetic core and a coil wound around the powder magnetic core. Such a powder magnetic core often includes ferrite, which is excellent in magnetic properties, freedom of shape, and cost merits.

In recent years, because of downsizing of power supplies for electronic devices or the like, there has been a strong demand for compact low-profile coil components that can be used even with a large current. Powder magnetic cores produced with an Fe-based soft magnetic material powder that has a saturation magnetic flux density higher than that of ferrite are increasingly used for powder magnetic cores for such coil components. As such an Fe-based soft magnetic material powder, for example, particles of Fe—Si-based alloy, Fe—Si—Al-based alloy or Fe—Si—Cr-based alloy are used. An insulating layer is exclusively formed on a surface of an alloy particle.

A Powder magnetic core obtained by consolidating an Fe-based soft magnetic material powder is formed by exclusively filling a pressing die composed of a punch and a die with a binder and a soft magnetic material powder, and subjecting the binder and the soft magnetic material powder to pressing under high pressure, followed by an annealing treatment at a temperature at which the binder does not decompose in a non-oxidizing atmosphere such as a vacuum atmosphere.

The insulating layer on the surface of the alloy particle may be broken by molding under high pressure. During the molding, the soft magnetic material powder with which the pressing die is filled is in close contact with the surface of the die at large surface pressure. When a green compact is taken out from the pressing die, the alloy particles on the surface side of the green compact may be largely plastically deformed, which may cause some streaky pressing flaws to be formed in a demolding direction in a close contact surface with the surface of the die (hereinafter, referred to as a sliding contact surface). In the site where the pressing flaws are formed in the surface of the green compact, the particles may extend in the demolding direction, which may cause the breakage of the insulating layer. As the alloy particles are softer and has higher malleability, direct contact between the alloy particles is likely to occur in the absence of inclusions such as the insulating layer. As the alloy particles are molded at higher pressure, the frequency of the direct contact increases. Finally, a thin metal layer (hereinafter referred to as a conductive portion) is formed on the sliding contact surface of the green compact. The insulating layers on the alloy particles are apt to be broken in the inside and on the surface of the powder magnetic core obtained by an annealing treatment, which causes the powder magnetic core to have insufficient insulation properties. As with the case of subjecting the green compact to machining processing, plastic deformation may occur on the alloy particles on the surface side together with the breakage of the insulating layer, which may cause direct contact between the alloy particles.

When the powder magnetic core has insufficient insulation properties and small electrical resistance, the magnetic core is apt to disadvantageously cause an increase in eddy-current loss in the coil component to cause an increase in magnetic core loss. Therefore, Patent Documents 1 and 2 disclose that a surface treatment is performed so as to exclude the conductive portion on the surface of the green compact in order to reduce the eddy-current loss.

PRIOR ART DOCUMENT

Patent Documents

Patent Document 1: JP-A-2006-229203
Patent Document 2: JP-A-2013-131676

SUMMARY OF THE INVENTION

Problems to be Solved by the Invention

Removal of the conductive portion on the surface of the green compact has a certain effect on improvement in electrical resistance on the surface of the magnetic core, but an effect on improvement in electrical resistance as a whole including the inside of the powder magnetic core cannot be expected. An alloy phase appears as it is on the surface of the portion in which the conductive portion is removed, and is apt to be rusted, which makes it necessary to separately perform a rust prevention treatment or the like.

Then, it is an object of the present invention to provide a method for manufacturing a powder magnetic core having excellent rust prevention while high electric resistance and high insulation properties are secured.

Means for Solving the Problems

The method for manufacturing a powder magnetic core of the present invention is a method for manufacturing a powder magnetic core having Fe-M (M: Al or Cr)-based alloy particles bonded via an oxide phase in which the element M is concentrated, in which the method includes: a first step of mixing a binder with a soft magnetic material powder containing Fe-M (M: Al or Cr)-based alloy particles on which an insulating layer is formed; a second step of filling a pressing die with a mixture obtained through the first step, subjecting the mixture to pressing to obtain a green compact, and slidingly demolding the green compact from the pressing die; a third step of processing the green compact after the second step and removing an expansion deformed matter of the alloy particles present in a region of pressing flaws formed on a surface of the green compact during the slidingly demolding; and a fourth step of subjecting the green compact after to the third step to a heat treatment to oxidize surfaces of the Fe-M (M: Al or Cr)-based alloy particles at a high temperature, so that the oxide phase is formed.

In the method of manufacturing a powder magnetic core of the present invention, it is preferable that the Fe-M-based alloy is an Fe—Al-based alloy, and Al is concentrated in the oxide phase.

It is preferable that the Fe—Al-based alloy further contains Cr, and a content of Al is greater than a content of Cr.

Effect of the Invention

The present invention can provide a method for manufacturing a powder magnetic core having excellent rust prevention while high insulation properties are secured.

MODE FOR CARRYING OUT THE INVENTION

Hereinafter, an embodiment of a method for manufacturing a powder magnetic core according to the present invention will be specifically described, but the present invention is not limited thereto.

Figure 1:
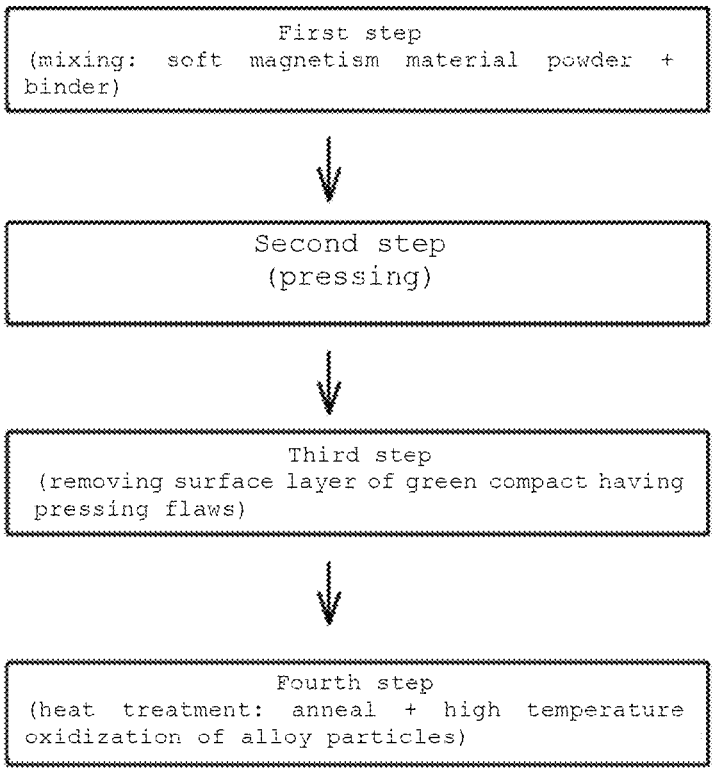
FIG. 1 is a step flow diagram for describing an embodiment of a method for manufacturing a powder magnetic core according to the present invention.

FIG. 1 is a step flow diagram for describing an embodiment of a method for manufacturing a powder magnetic core according to the present embodiment. The method for manufacturing a powder magnetic core of the present embodiment includes a first step of mixing a binder with a soft magnetic material powder containing Fe-M (M: Al or Cr)-based alloy particles on which an insulating layer is formed; a second step of filling a pressing die with a mixture obtained through the first step, subjecting the mixture to pressing to obtain a green compact, and slidingly demolding the green compact from the pressing die; a third step of processing the green compact after the second step and removing an expansion deformed matter of the alloy particles present in a region of pressing flaws formed on a surface of the green compact during the slidingly demolding; and a fourth step of subjecting the green compact after the third step to a heat treatment to oxidize surfaces of the Fe-M (M: Al or Cr)-based alloy particles at a high temperature, so that the oxide phase is formed. In the obtained powder magnetic core, the Fe-M (M: Al or Cr)-based alloy particles are bonded via an oxide phase in which the M element is concentrated.

In the fourth step, the green compact is subjected to a heat treatment to oxidize the surfaces of the Fe-M (M: Al or Cr)-based alloy particles at a high temperature, so that an oxide phase containing Fe and the M element is formed, which causes the alloy particles to be bonded via the oxide phase. This achieves insulation between the alloy particles, which provides a powder magnetic core having high insulation properties provided by the oxide phase and excellent rust prevention properties.

[First Step]

First, a soft magnetic material powder to be subjected to a first step will be described. An Fe-based soft magnetic material powder is not particularly limited as long as the Fe-based soft magnetic material powder has magnetic properties capable of constituting a powder magnetic core and can form an oxide phase containing an element constituting the soft magnetic material powder. The following various types of magnetic alloys can be used.

The specific composition of the Fe-based soft magnetic material powder is not particularly limited as long as the Fe-based soft magnetic material powder can constitute a powder magnetic core having desired magnetic properties, but a preferred embodiment is an alloy powder in which a base element having the largest content is Fe and an element having the second largest content is Al or Cr. Here, Al or Cr means either Al or Cr. However, the element is not limited to only any one of Al and Cr. The alloy may contain Cr even when the alloy contains Al, or the alloy may contain Al even when the alloy contains Cr. Examples of the Fe-based soft magnetic material powder include Fe—Si—Cr-based, Fe—Si—Al-based, Fe—Al—Cr-based, and Fe—Al—Cr—Si-based soft magnetic material powders. Since these alloy powders contain Al and Cr in addition to the base element Fe, the alloy powders themselves have excellent corrosion resistance as compared with pure Fe.

An oxide of Fe constituting the alloy and an oxide of a nonferrous metal such as Al or Cr have high electric resistance as compared with a metal simple substance or an alloy of the metal simple substance. The present inventors have found that, even when the insulating layer of the alloy particles is broken in the manufacturing process of the powder magnetic core, an oxide phase containing the M element of Al or Cr is interposed as a grain boundary phase between the alloy particles, to bind the alloy particles, and an oxide mainly composed of Fe derived from the alloy is formed on the surface of the powder magnetic core, so that the electrical resistance of the magnetic core can be increased to improve the insulating properties. In other words, the finding is to positively oxidize a region from which a conductive portion including the connected alloy particles of the soft magnetic material powder is removed to form an oxide of Fe or M element, and the oxide is caused to function as an insulating layer. As a technique of oxidation, a heat treatment in an oxygen-containing atmosphere is adopted. In particular, in order to reduce the manufacturing cost, the technique is preferably performed in the air without requiring a special facility device.

Al is an element effective for enhancing the corrosion resistance or the like of the alloy particles themselves and improving the strength of the powder magnetic core. An increase in Al provides a decrease in a magnetic anisotropy constant and an increase in a magnetic permeability. The coercive force of the alloy is proportional to the magnetic anisotropy constant, so that the hysteresis loss can be reduced and the magnetic core loss can be improved. On the other hand, a saturation magnetic flux density decreases. From the viewpoint, for example, an Fe—Al-based alloy preferably contains 4.0% by mass or more and 14.0% by mass or less of Al. The Fe—Al-based alloy more preferably contains 5.0% by mass or more and 13.0% by mass or less of Al.

Cr is effective in enhancing the corrosion resistance or the like of the alloy particles themselves. The excessive amount of Cr causes a decrease in the saturation magnetic flux density, so that from this viewpoint an Fe—Cr-based alloy preferably contains 1.0% by mass or more of Cr. The amount of Cr is more preferably 2.5% by mass or more. On the other hand, the amount of Cr is preferably 9.0% by mass or less. The amount of Cr is more preferably 7.0% by mass or less, and still more preferably 4.5% by mass or less.

It is preferable for an Fe—Al—Cr-based alloy that Al is contained in the above-mentioned range, Cr is contained in an amount of 16.5% by mass or less in total of Cr with Al, and the content of Al is greater than the content of Cr.

Further addition of Si is effective in improving magnetic properties. On the other hand, the excessive amount of Si causes a reduction in the strength of the magnetic core, so that the amount of Si is preferably 5.0% by mass or less. From the viewpoint of the strength, the amount of Si is preferably the level of inevitable impurities. For example, the amount of Si is preferably regulated to less than 0.5% by mass.

The soft magnetic material powder may also contain other elements as long as the soft magnetic material powder exhibits advantages such as moldability and magnetic properties. However, a nonmagnetic element becomes a factor for a decrease in the saturation magnetic flux density or the like, so that the amount of the nonmagnetic element is more preferably 1.0% by mass or less excluding inevitable impurities. It is preferable that the soft magnetic material powder is composed of Fe, Al or Cr except for inevitable impurities and further contains Si.

For example, the average particle size of the alloy particles of the soft magnetic material powder (here, the median size d50 in the cumulative particle size distribution is used) is not particularly limited, and may be 1 μm or more and 100 μm or less. The strength, magnetic core loss, and high-frequency properties of the magnetic core are improved by reducing the average particle size, so that the median size d50 is more preferably 30 μm or less, and still more preferably 15 μm or less. On the other hand, when the average particle size is small, the magnetic permeability decreases, so that the median size d50 is more preferably 5 μm or more.

The form of the alloy particle is not also particularly limited. For example, from the viewpoint of fluidity or the like, a granular powder typified by an atomized powder is preferably used. An atomization method such as gas atomization or water atomization is suitable for producing an alloy powder that has high malleability and ductility and is hard to be pulverized. The atomization method is also suitable for obtaining a substantially spherical soft magnetic material powder.

On a surface of an alloy particle obtained by the water atomization method, an oxide layer of Fe, M element or Si having a thickness of about 5 to 20 nm may be formed in a layer form or an island form. Here, the island form refers to a state where an oxide containing Al or Cr is scattered on the surfaces of the alloy particles constituting the soft magnetic material powder. Such a natural oxide layer functions as an insulating layer, provides a rust prevention effect on the alloy particles, and makes it possible to store the soft magnetic material powder in the air and to prevent excessive oxidation of the green compact in a heat treatment, which is preferable. The alloy particles may be heated and oxidized by subjecting the soft magnetic material powder to a heat treatment in the air, to form an oxide layer. As another method, an insulating layer may be formed on the alloy particles of the soft magnetic material powder by a sol-gel method or the like.

Next, a binder used in the first step will be described. The binder binds powder alloy particles during pressing and withstands handling after molding. In the third step, the binder imparts to the green compact such a certain degree of strength that, when the green compact is subjected to machining processing, an expansion deformed matter of the alloy particles present in a region of pressing flaws of the green compact can be removed or the alloy particles present in a region of pressing flaws can be fallen off and removed. Here, falling-off means that the alloy particles are out of binding and the alloy particles fall away from the green compact.

For example, any of various thermoplastic organic binders may be used, such as polyethylene, polyvinyl alcohol (PVA), and acrylic resins. The organic binders are thermally decomposed by the heat treatment after the molding. When carbon derived from the organic binders remains, the organic binders may suppress the formation of the oxide of the M element in the oxide phase between the alloy particles formed by high temperature oxidation, and the ratio of the oxide of Fe or the like may be increased as compared with the oxide of the M element, which causes a decrease in the electrical resistance of the magnetic core. Therefore, the binder is preferably removed under a condition in which residual carbon does not occur as much as possible by for example slowing a temperature increase rate in a temperature range including the decomposition temperature of the organic binder.

Furthermore, a silicone resin as an inorganic binder may be used together with the organic binder. When the silicone resin is used in combination, the oxide phase contains Si.

The amount of the binder to be added may be such that the binder can be sufficiently spread between the soft magnetic material powders to ensure a sufficient green compact strength. On the other hand, the excessive amount of the binder decreases the density and the strength. For example, the amount of the binder is preferably 0.25 to 3.0 parts by weight based on 100 parts by weight of the soft magnetic material powder.

The method for mixing the soft magnetic material powder and the binder in the first step is not particularly limited, but a mixing/dispersing apparatus such as an attritor is preferably used.

The mixture obtained by mixing is preferably subjected to a granulation process from the viewpoint of moldability or the like. Although various methods can be applied to such a granulation process, a granulation method particularly preferably includes a spray drying step. In the spray drying step, a slurry-like mixture containing a soft magnetic material powder, a binder, and a solvent such as water is spray-dried using a spray dryer. The spray drying provides a granulated powder having a sharp particle size distribution and a small average particle size. The spray drying can provide a substantially spherical granulated powder, so that powder feeding properties (powder flowability) during molding are also improved. The average particle size (median size d50) of the granulated powder depends on the average particle size of the alloy particles of the soft magnetic material powder, and is preferably 40 to 150 μm, and more preferably 60 to 100 μm.

As the granulation method, a method such as tumbling granulation may be applied. The granulated powder obtained by tumbling granulation is an agglomerated powder having a wide particle size distribution. By passing the granulated powder through a sieve such as a vibration sieve, a desired granulated powder suitable for pressing can be obtained.

A lubricant such as stearic acid, a stearic acid salt or zinc stearate is preferably added to the granulated powder in order to reduce friction between the powder and the pressing die during pressing. The amount of the lubricant to be added is preferably 0.1 to 2.0 parts by weight based on 100 parts by weight of the soft magnetic material powder. On the other hand, the lubricant can also be applied or sprayed to the pressing die. When the lubricant is used, Zn or the like derived from the lubricant is contained in the oxide phase.

[Second Step]

Next, a second step of subjecting the granulated powder obtained through the first step to pressing will be described. The granulated powder obtained in the first step is suitably granulated as described above and subjected to the second step. The granulated powder is pressed into a predetermined shape such as a cylindrical shape, a rectangular parallelepiped shape, a toroidal shape, an E shape, a U shape, a pin shape, or a drum shape by using a pressing die. The molding in the second step may be room temperature molding or warm molding performed during heating such that an organic binder does not disappear.

Figure 2:
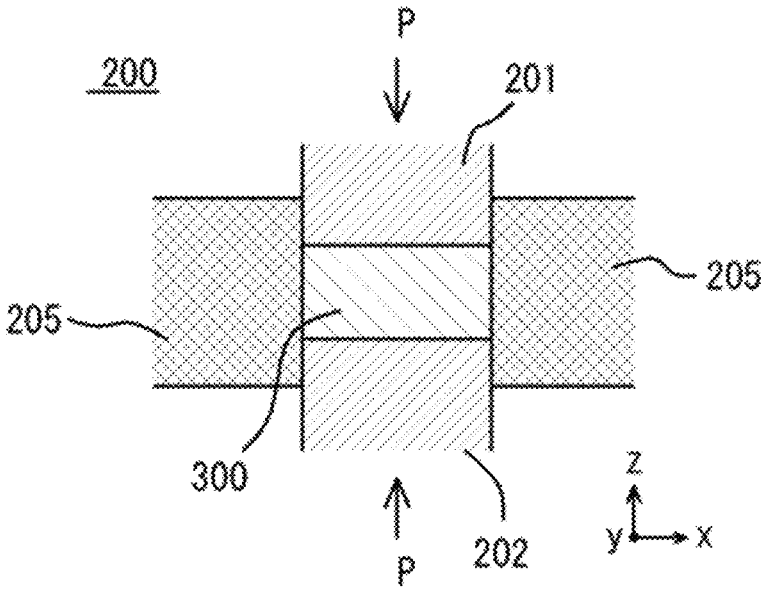
FIG. 2 is a view for describing a second step of the method for manufacturing a powder magnetic core according to the present invention.
Figure 3:
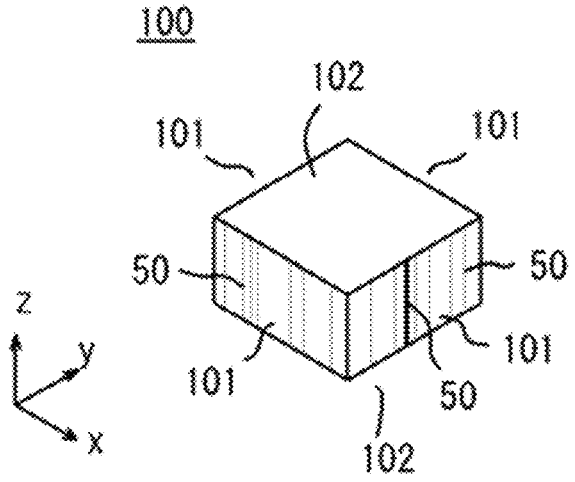
FIG. 3 is a perspective view of a green compact obtained in the second step.

FIG. 2 is a view for describing pressing, and FIG. 3 is a perspective view showing an appearance of a green compact obtained by pressing. The pressing die may have various modes depending on the shape of the green compact or the like, but the illustrated example shows the configuration of the pressing die for pressing a rectangular flat plate green compact. As shown in FIG. 2, a pressing die 200 includes an upper punch 201, a lower punch 202, and a die 205. An opening into which the upper punch 201 and the lower punch 202 can be inserted is provided in the central portion of the die 205. A cavity provided by combining the lower punch 202 with the opening of the die 205 is filled with a granulated powder 300. The upper punch 201 is inserted into the opening of the die 205 so as to close the cavity. The granulated powder is pressurized in a Z direction in FIG. 2 such that the pair of upper and lower punches 201 and 202 come close to each other, to mold the granulated powder into a predetermined shape. The pressure force is released such that the upper and lower punches 201 and 202 are moved away from each other in the Z direction. Furthermore, the lower punch 202 is moved in the Z direction so that a green compact 100 appears on the upper side of the die 205, and the green compact 100 is demolded while sliding from the pressing die 200 (that is, slidingly demolded).

As shown in FIG. 3, a pressure surfaces 102 formed by pressing the upper and lower punches 201 and 202, and a sliding contact surface 101 that abuts on the die 205 and slides on the surface of the die 205 upon slidingly demolding of the green compact 100 appear on the surface of the resulting green compact 100 having a rectangular flat plate-shape.

Figure 4:
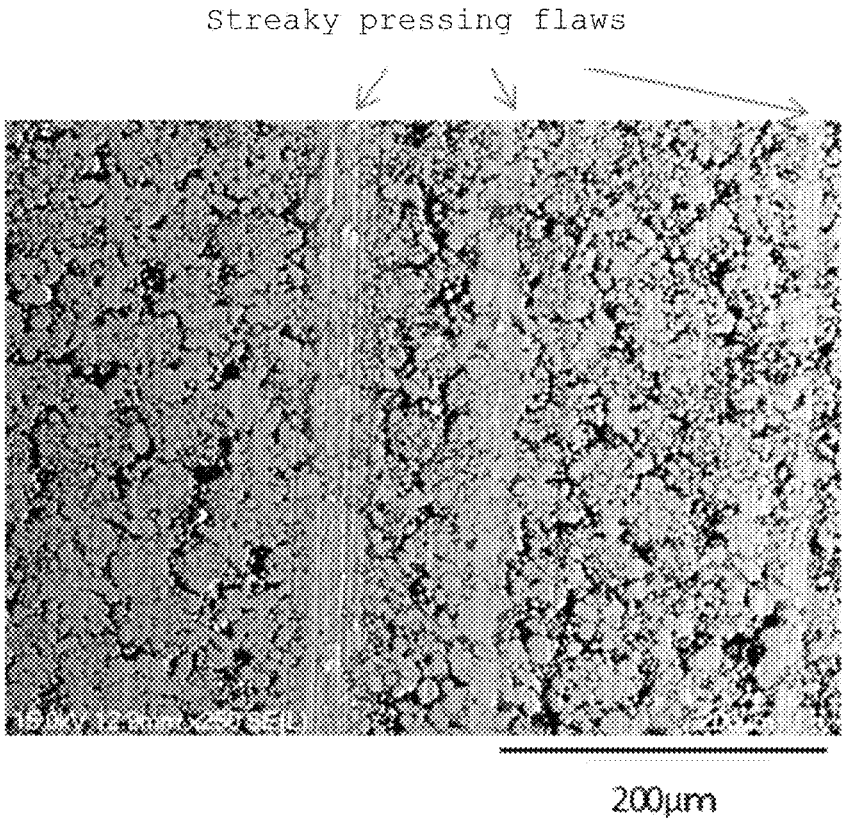
FIG. 4 is an SEM photograph of a sliding contact surface of the green compact obtained in the second step.

FIG. 4 is an SEM photograph of the sliding contact surface of the green compact observed with a scanning electron microscope (SEM). A plurality of streaky pressing flaws are formed on the sliding contact surface 101 of the green compact 100 across two pressure surfaces 102 of the green compact 100 in the Z direction in FIG. 3 (the vertical direction of the photograph in FIG. 4). As the molding pressure increases, the number of the pressing flaws 50 also increases, and the plurality of pressing flaws 50 are joined and appear in a planar form as a conductive portion.

Figure 5A:
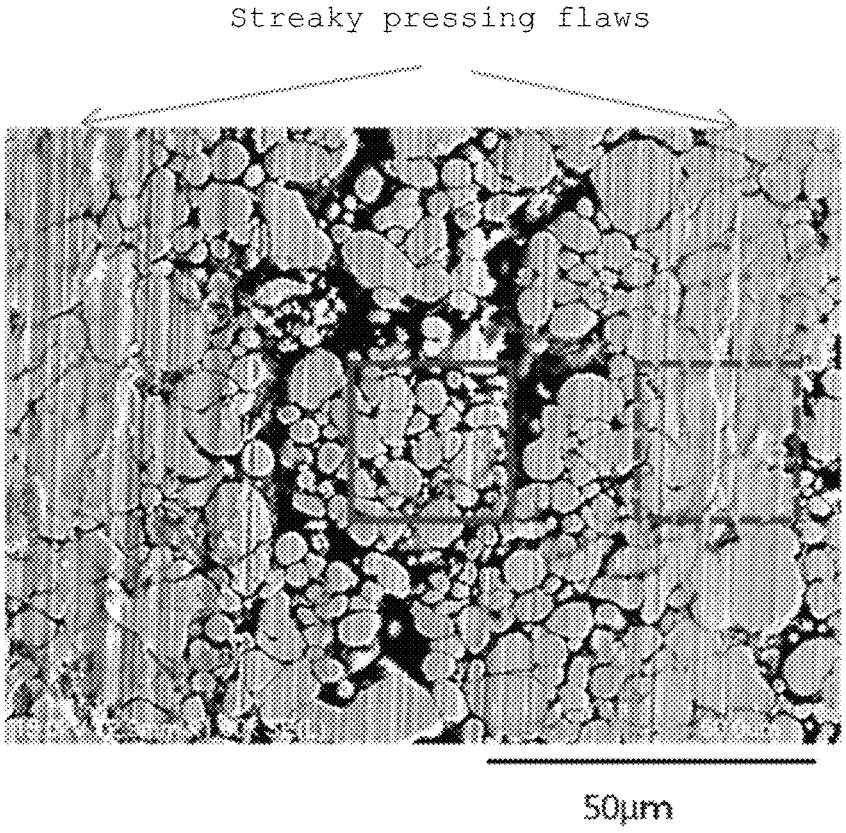
FIG. 5A is an SEM photograph when the sliding contact surface of the green compact obtained in the second step is enlarged and observed.
Figure 5B:
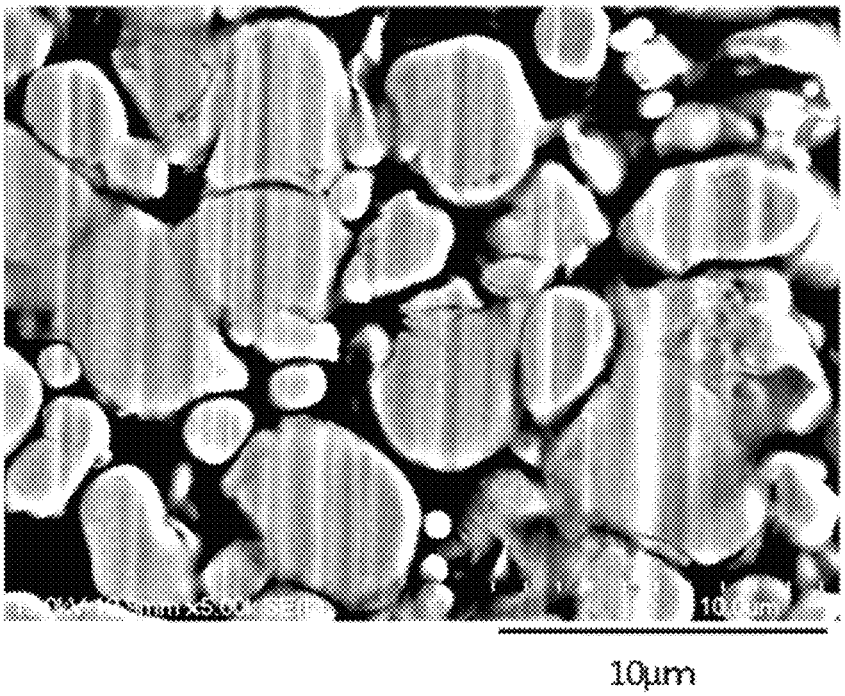
FIG. 5B is an SEM photograph when a surface portion of the sliding contact surface of the green compact in which pressing flaws are not formed is enlarged and observed.
Figure 5C:
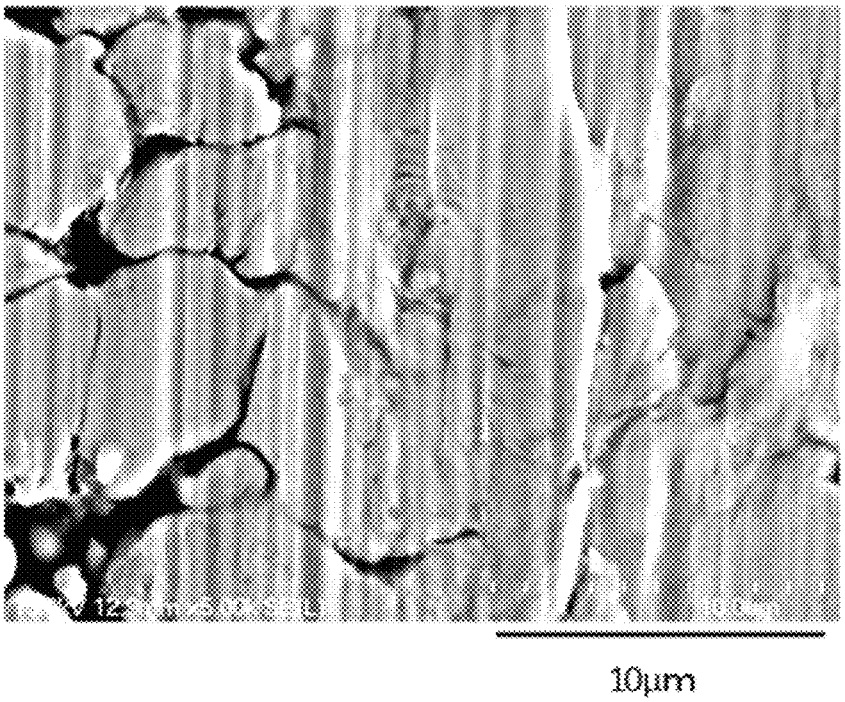
FIG. 5C is an SEM photograph when a surface portion of the sliding contact surface of the green compact in which pressing flaws are formed is enlarged and observed.

FIG. 5A is an SEM photograph when the sliding contact surface of the green compact is enlarged and observed, FIG. 5B is an SEM photograph when a surface portion in which clear pressing flaws are not confirmed (a region surrounded by a solid line in FIG. 5A) is enlarged and observed, and FIG. 5C is an SEM photograph when a surface portion in which clear pressing flaws are formed (a region surrounded by a dash line in FIG. 5A) is enlarged and observed. In FIG. 5, the alloy particles of the soft magnetic material powder are observed with a light color, and the portions of the binder and the pores between the alloy particles are observed with a relatively dark color. When the surface portion of the green compact 100 in which the pressing flaws 50 are formed is enlarged and observed, a plurality of alloy particles undergo expansion deformation or shear deformation in the Z direction as shown in FIG. 5C, and a region where the deformed portions are brought into direct contact with each other (the insulating layer is broken and serves as a conductive portion) is observed. In this region, an expansion deformed matter caused by expansion deformation or shear deformation remains to be present. As shown in FIG. 5B, it is confirmed that the pressing flaws 50 are not clearly observed in the sliding contact surface 101, but a portion where the alloy particles are brought into direct contact with each other is also present in a relatively small region. The surface states of the upper and lower punches 201 and 202 are transferred to the pressure surface 102 of the green compact 100, but the pressing flaws 50 in the sliding contact surface 101 are not observed.

Figure 6:
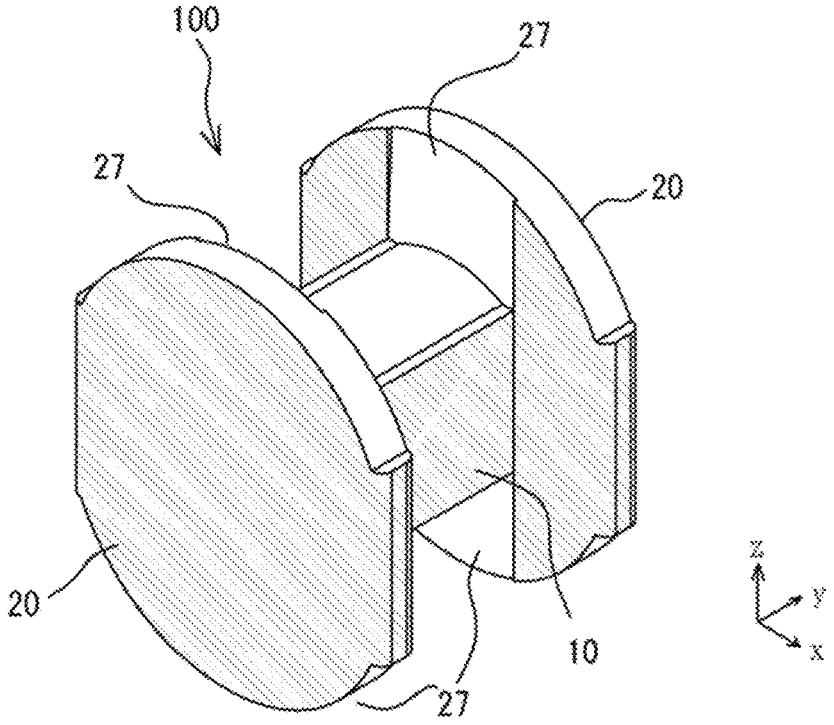
FIG. 6 is a perspective view showing another mode of the green compact obtained in the second step.

The shape of the green compact is not limited to a rectangular flat plate shape, and the green compact can be molded into a shape such as a cylindrical shape, a rectangular parallelepiped shape, a toroidal shape, an E shape, a U shape, a pin shape, or a drum shape. FIG. 6 is a perspective view of a drum-shaped green compact showing another mode of the green compact. The green compact 100 with a drum shape includes a flange portion 20 projecting so as to protrude from both ends of a shaft portion 10 with a columnar shape. When the flange portion 20 is provided only on one end side of the shaft portion 10, the green compact is referred to as a pin-shaped green compact. In FIG. 6, a portion abutting on the inner surface of the die 205 is shown by hatching.

Figure 7:
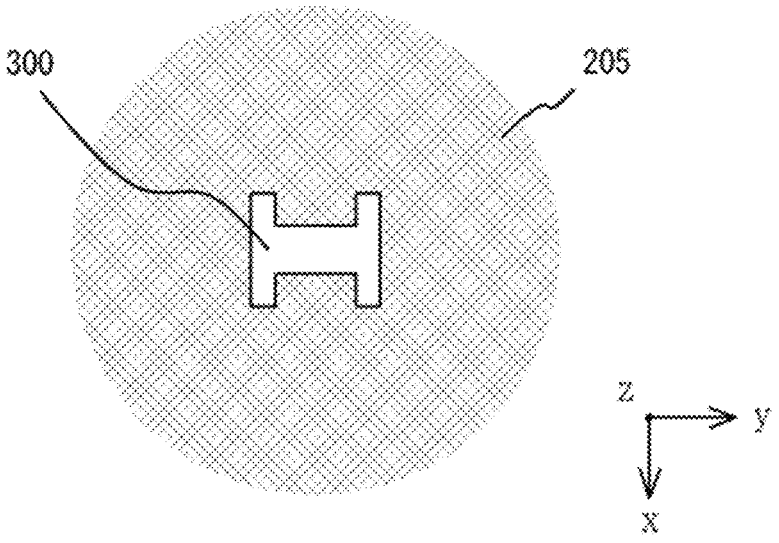
FIG. 7 is a view of a pressing die for a drum-shaped green compact as viewed in a pressure direction.

Examples of the drum-shaped green compact include, but are not limited to, a green compact including a shaft portion 10 with a columnar shape and flange portions 20 on both end sides thereof with a disk shape; a green compact including a shaft portion 10 with a columnar shape and flange portions 20 on both end sides thereof with a disk shape on one end side and a square shape on the other end side; a green compact including a shaft portion 10 with a columnar shape and flange portions 20 on both end sides thereof with a square shape; and a green compact including a shaft portion 10 with a quadrangular prism shape and flange portions 20 on both end sides thereof with a square shape. In the drum-shaped green compact shown in FIG. 6, the flange portion 20 has a substantially elongated circle shape and includes opposite linear portions and a circular arc portion connecting the linear portions. The linear portions includes a stepped portion in a connecting portion with the circular arc portion, projects outward, and has a chamfered shape having a thickness decreasing toward an end face in a projecting direction. The shaft portion 10 includes opposite flat surfaces and a convex surface connecting the flat surfaces, and the flat surfaces are substantially parallel to the linear portion of the flange portion 20. In the surface of the flange portion 20 on the shaft portion 10 side, a tapered groove 27 is provided, which extends from the circumferential surface of the circular arc portion of the flange portion 20 to the convex surface of the shaft portion 10 and is shallower toward the shaft portion 10. In FIG. 6, the Z direction is a pressure direction during molding. FIG. 7 is a view of a pressing die for a drum-shaped green compact as viewed in a pressure direction. The inner surface of the die 205 abuts on the shaft portion 10 and the flange portion 20 of the drum-shaped green compact 100. Therefore, in the green compact 100 with a drum shape, many portions serve as the sliding contact surface 101.

[Third Step]

Next, a third step of processing the green compact after the second step and removing an expansion deformed matter of the alloy particles present in a region of pressing flaws formed on a surface of the green compact during the slidingly demolding will be described.

Figure 8:
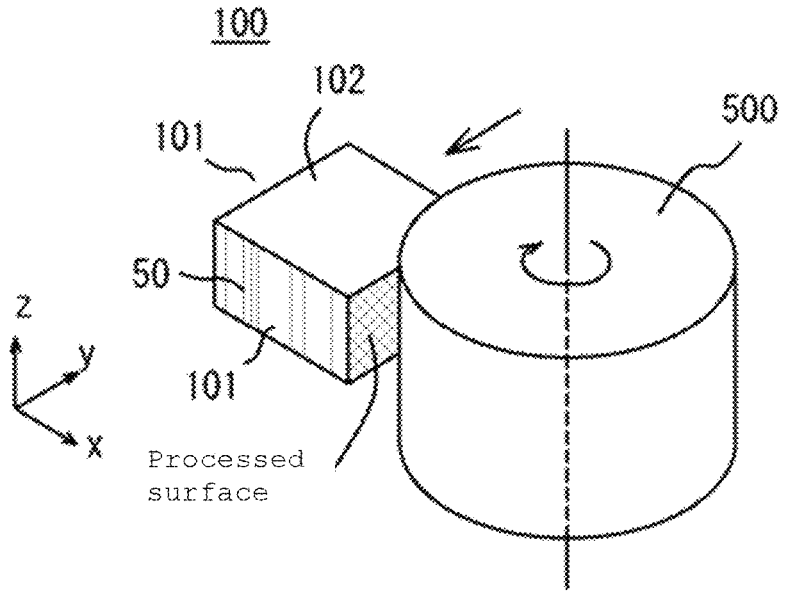
FIG. 8 is a view for describing a third step of the method for manufacturing a powder magnetic core according to the present invention.

FIG. 8 is a view for describing removal processing of a surface layer in the region of the pressing flaws of the green compact. Here, the removal processing refers to processing for removing the surface layer of the sliding contact surface 101 of the green compact 100 so as to reduce a region where the plurality of alloy particles present in the region of the pressing flaws are expansion deformed or shear deformed, and the deformed portions are brought into direct contact with each other (corresponding to an expansion deformed matter. These also constitute the conductive portion). The amount to be removed depends on the degree of the pressing flaws due to the softness and malleability of the alloy particles used for the green compact, and the average particle size of the alloy particles, but processing is preferably performed so that as a guide the pressing flaws 50 are not visually observed by the removal amount of 5 μm or more from the surface of the green compact.

The removal processing can be performed using processing means such as a resin brush. In the example shown in FIG. 8, the pressing flaws in the sliding contact surface 101 of the green compact 100 are removed by a rotating brush 500. In the removal processing, the entire surface of the sliding contact surface 101 is preferably processed, but the insulating properties of the magnetic core can be enhanced merely by selectively removing the pressing flaws 50 in the sliding contact surface 101. Furthermore, the entire surface including the pressure surface 102 of the green compact 100 may be processed. As the resin brush, a commercially available resin brush may be used, and 6 nylon, nylon with abrasive grains, or a cotton yarn buffing wheel may be used.

As long as the green compact is not damaged, the processing treatment is not limited to the method using the resin brush. For example, a mechanical treatment such as polishing processing with a grinding stone, polishing processing with shot blasting, barrel polishing processing (preferably dry type), or laser polishing processing can be used. The processing treatment may be an acid treatment using hydrochloric acid, sulfuric acid, nitric acid or the like, or chemical etching. In any case, however, processing conditions that do not give significant damage to the insulating layer formed on the surface of the alloy particle are selected. More preferably, the processing treatment is machining processing performed such that the alloy particles on the surface side having the pressing flaws of the green compact fall off without breakage of the insulating layer.

Between the second step and the third step or between the third step and the fourth step, deburring or chamfering processing may be performed separately from the processing in the third step.

[Fourth Step]

Next, a fourth step of subjecting the green compact after the third step to a heat treatment will be described. In the fourth step, the green compact is subjected to a heat treatment in an oxidizing atmosphere, so that annealing to alleviate a stress strain applied to the alloy particles during molding is performed and an oxide is formed during oxidation (high-temperature oxidation). Accordingly, the oxide is formed in the inside of the magnetic core and on the surface of the magnetic core. In the inside of the magnetic core, the alloy particles are bonded via an oxide phase containing M element. The oxide phase interposed between the alloy particles and the oxide on the surface are formed by the surface oxidation of the alloy particles by the heat treatment, but the constitution differs depending on the alloy composition and the heat treatment conditions.

As for the oxide phase interposed between the alloy particles, for example, in the case of an Fe—Al-based alloy, Al is concentrated, and a corundum type oxide in which Fe and Al form solid solution $(Fe, Al)_2O_3$), FeO, $Fe_2O_3$, $Fe_3O_4$ or the like may be present in addition to $Al_2O_3$ as the oxide. In the case of an Fe—Cr-based alloy, Cr is concentrated in the oxide phase interposed between the alloy particles, and a corundum type oxide in which Fe and Cr form solid solution ($(Fe, Cr)_2O_3$), FeO, $Fe_2O_3$, $Fe_3O_4$ or the like may be present in addition to $Cr_2O_3$ as the oxide. In the case of an Fe—Al—Cr-based alloy containing more Al than Cr, Al is concentrated in the oxide phase interposed between the alloy particles, and a corundum type oxide in which Fe, Al, and Cr form solid solution Fe $(Fe, Al, Cr)_2O_3$), $Cr_2O_3$, FeO, $Fe_2O_3$, $Fe_3O_4$ or the like may be present in addition to $Al_2O_3$. Furthermore, even when the alloy contains Si, the oxide phase may contain an oxide of Si. Here, the concentrating of M element means that the ratio of the M element to the sum of Fe and M elements is higher than the ratio in the alloy composition.

The production process of the oxide derived from the alloy during high temperature oxidation is complicated, and the mechanism thereof is unknown. The reason is not clear, but the affinity of each element with oxygen (O), the ion radius, and the oxygen partial pressure in the oxidation process and the like are inferred to have an effect on the production process. The M element that is Al or Cr constituting the soft magnetic material powder has an affinity with O higher than that of Fe, and Al has an affinity with O higher than that of Cr. When the green compact is oxidized at a predetermined high temperature in an oxygen-containing atmosphere, the oxides of the M element and Fe having a high affinity for O are formed, and the M element having a high affinity with O is concentrated in the oxide phase. When Al and Cr are contained as the M element, Al is concentrated in the oxide phase when the oxide phase contains Al larger than Cr. Such an oxide covers the surfaces of the alloy particles of the soft magnetic material powder, fills the space between the alloy particles to firmly connect the particles, and functions as an insulating layer between the particles. In addition, the oxide is formed on the surface of the green compact, thereby functioning as a surface insulating layer of the magnetic core.

When the insulating layer of the alloy particles is damaged by the machining processing in the third step and the machining processing is excessive processing performed such that even many alloy particles are scraped off, the surfaces of the alloy particles are excessively oxidized, and the oxide to be formed is apt to be mainly composed of Fe such as FeO, $Fe_2O_3$, or $Fe_3O_4$. Such an oxide mainly composed of Fe has resistance lower than that of the oxide mainly composed of the M element such as $Al_2O_3$ or $Cr_2O_3$, so that it is desirable to select processing in which the breakage of the insulating layer of the alloy particles is suppressed in the third step described above.

The heat treatment can be performed in an atmosphere in which oxygen is present, such as in the air or in a mixed gas of oxygen and an inert gas. Among them, the heat treatment in the air is simple, which is preferable. The pressure during the heat treatment atmosphere is not also particularly limited, but the heat treatment is preferably performed in the air not requiring pressure control. The heat treatment in the fourth step may be performed at a temperature at which the oxide layer is formed, but the heat treatment is preferably performed at a temperature at which the soft magnetic material powder is not significantly sintered. As the sintering of the soft magnetic material powder proceeds, necking occurs, which causes the alloy particles to be connected, so that the electric resistance is lowered. Specifically, the temperature is preferably in the range of 700 to 900° C., and more preferably in the range of 700 to 800° C., in order to prevent the magnetic core loss from increasing and to form the oxide phase between the alloy particles and the oxide of Fe. The holding time is appropriately set depending on the size of the magnetic core, the treatment amount, the allowable range of variation in characteristics or the like, and is preferably 0.5 to 3 hours, for example.

A space factor that is the percentage of the soft magnetic material powder in the magnetic core subjected to the heat treatment is more preferably set to the range of 80 to 95%. The reason why such a range is preferable is that an increase in the space factor provides an improvement in the magnetic properties, whereas an excessive increase in the space factor is apt to cause cracks to occur in the inside of the green compact. The space factor is more preferably in range of 84 to 92%. The magnetic core itself obtained as described above exhibits an excellent effect. That is, high insulation properties and excellent corrosion resistance are achieved.

The magnetic core obtained as described above achieves high insulation properties and excellent corrosion resistance. The specific configuration thereof is a magnetic core having a processed surface. Alloy particles of a soft magnetic material powder are bonded via an oxide phase containing Fe and an M element, and an oxide containing Fe and an M element is present also on a surface side of the magnetic core including the processed surface. Here, the "processed surface" means that the surface of the green compact is a surface formed by the above-described processing, and the properties of the surface themselves are irrelevant. That is, the case where an oxide is formed through the heat treatment in the fourth step after processing in the third step also means the processed surface.

Figure 9:
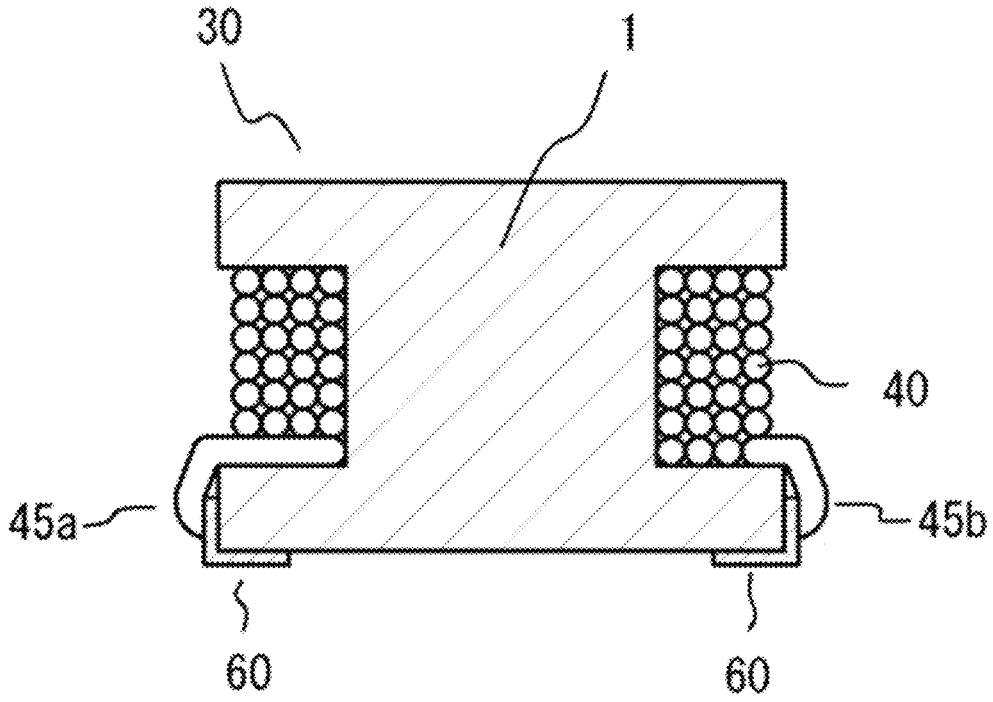
FIG. 9 is a cross-sectional view of a coil component including a drum-shaped powder magnetic core.

The magnetic core has high insulation properties, so that a coil component can be provided in which a coil is formed by direct winding around the magnetic core and terminal electrodes for connecting end portions of the coil are directly formed on the processed surface. FIG. 9 is a cross-sectional view of a coil component including a drum-shaped magnetic core. As shown in FIG. 9, each of terminal electrodes 60 are formed a flange portion of the magnetic core. In the terminal electrode 60, for example, a conductor paste containing metal particles containing Ag and Pt and a glass powder is printed or applied and baked, thereafter a plated layer such as Ni or Sn plating is formed on the baked conductor paste. Both end portions 45*a* and 45*b* of a coil 40 are soldered to each of the terminal electrodes 60 to form a coil component 30. A resin bobbin or the like may not be used, so that the coil component to be obtained can be downsized.

EXAMPLES

As a soft magnetic material powder used in a method for manufacturing a magnetic core, first, a soft magnetic material powder was prepared as follows, which was made of Fe—Al—Cr-based alloy having an alloy composition of 91.0% Fe-5.0% Al-4.0% Cr in mass percentage. The soft magnetic material powder was a spherical water atomized powder, and a natural oxide layer made of $Al_2O_3$ having a thickness of about 10 nm was formed on the surface of the alloy. The soft magnetic material powder had an average particle size (median diameter d50) of 18.5 μm as measured with a laser diffraction/scattering particle size distribution analyzer (LA-920 manufactured by HORIBA, Ltd.).

To 100 parts by weight of the soft magnetic material powder, 2.5 parts by weight of PVA (POVAL PVA-205 manufactured by KURARAY CO., LTD., solid content 10%) as a binder was mixed (first step). The obtained mixture was dried at 120° C. for 1 hour, and then passed through a sieve to obtain a granulated powder. To 100 parts by weight of the granulated powder, 0.4 parts by weight of zinc stearate was added, followed by mixing, to obtain a mixture to be subjected to pressing. The obtained mixture was pressed at room temperature at a molding pressure of 0.8 GPa using a pressing machine to obtain a disk-shaped green compact (second step). The obtained green compact had a dimension of ϕ6.5×5 mm. The space factor and density evaluated in the green compact were respectively 84.9% and $6.22\times10^3$ kg/m$^3$. The opposite flat surfaces of the green compact each serve as a pressure surface to abut on a punch of a pressing die, and a peripheral surface (side surface) connecting the flat surfaces serves as a sliding contact surface to abut on a die. In visual confirmation provided by a metallurgical microscope, no pressing flaws occurring during demolding were confirmed in the pressure surface, but a large number of pressing flaws occurred in the thickness direction of the green compact in the sliding contact surface. The alloy particles were confirmed to be expansion deformed or shear deformed to provide an expansion deformed matter in a planar form. In the expansion deformed region, the alloy particles were brought into direct contact with each other to form a conductive portion. Ten green compacts were prepared, but in each case, the expansion deformed region had an area of about 70% with respect to the total area of the sliding contact surface.

The whole of the sliding contact surface of the obtained green compact was processed with a resin brush attached to an electric cutting tool (electric microgrinder) to a state where pressing flaws could not be visually confirmed. The green compact after processing had a dimension of $\phi 6.5 \times 4.9$ mm (third step). As the resin brush, a radial bristle disk manufactured by 3M Japan Co., Ltd. including aluminum oxide for abrasive grains was used.

The processed green compact was subjected to a heat treatment at a heat treatment temperature of 800° C. for 1.0 hour in the air, to obtain a disk-shaped magnetic core (fourth step). The space factor and density evaluated in the magnetic core after the heat treatment were 88.9% and $6.40 \times 10^3$ kg/m$^3$, respectively.

The specific resistance of the disk-shaped magnetic core was evaluated. First, a conductive adhesive was applied to two opposite planes of the magnetic core, dried and solidified to prepare an object to be measured. The object to be measured was set between electrodes, and a resistance value R (Ω) was measured by applying a direct current voltage of 50 V using an electric resistance measuring device (8340A manufactured by ADC Corporation). Specific resistance ρ (Ωm) was calculated according to the following equation from the area A (m$^2$), the thickness t (m) and the resistance value R (Ω) of the plane of the object to be measured.

$$\text{Specific resistance } \rho\ (\Omega\text{m}) = R \times (A/t)$$

The magnetic core in Example had a specific resistance of $1 \times 10^5$ Ωm to $3 \times 10^5$ Ωm and excellent insulation properties. In each of the green compacts not subjected to the heat treatment, the specific resistance was in a conductive state.

Figure 10A:
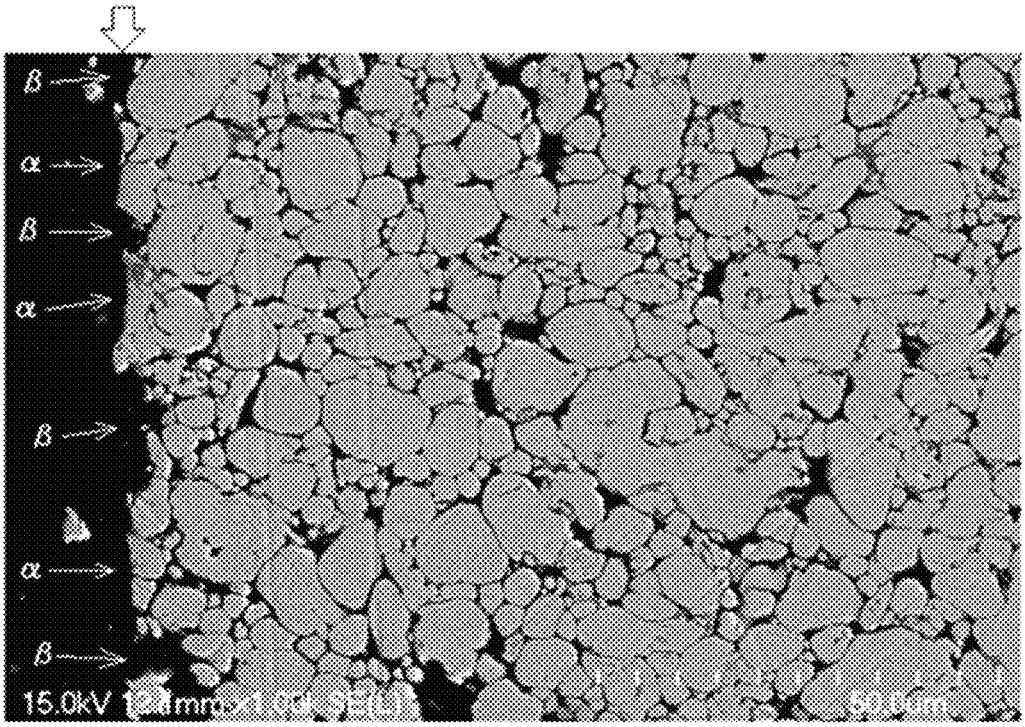
FIG. 10A is an SEM photograph of a cross section of a powder magnetic core manufactured in Example.
Figure 10B:
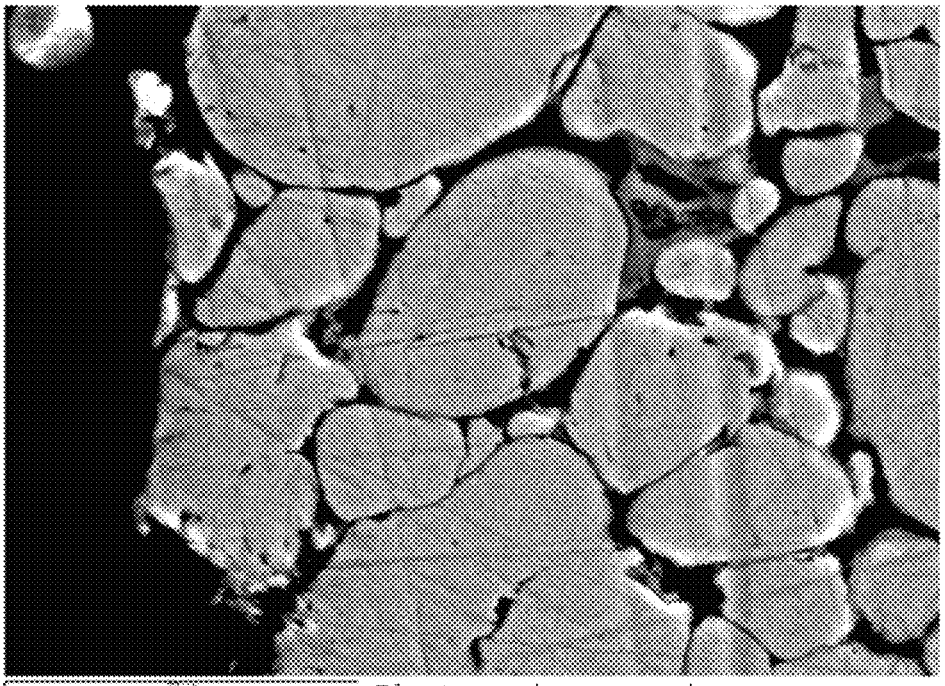
FIG. 10B is an enlarged SEM photograph of the cross section of the powder magnetic core manufactured in Example.
Figure 10C:
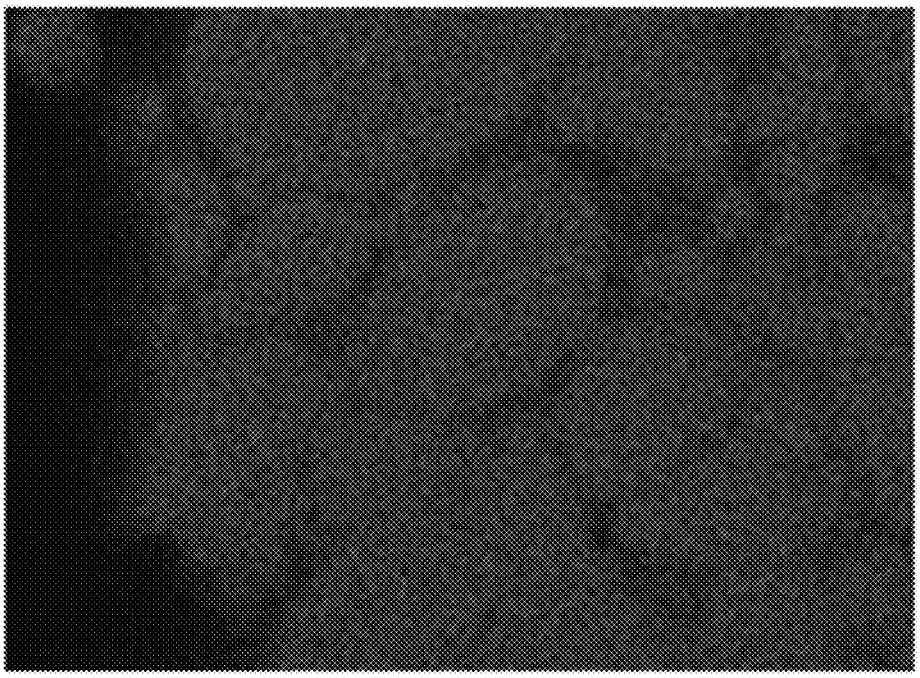
FIG. 10C is a mapping diagram showing the distribution of Fe corresponding to an observation field of view of the SEM photograph of FIG. 10B.
Figure 10D:
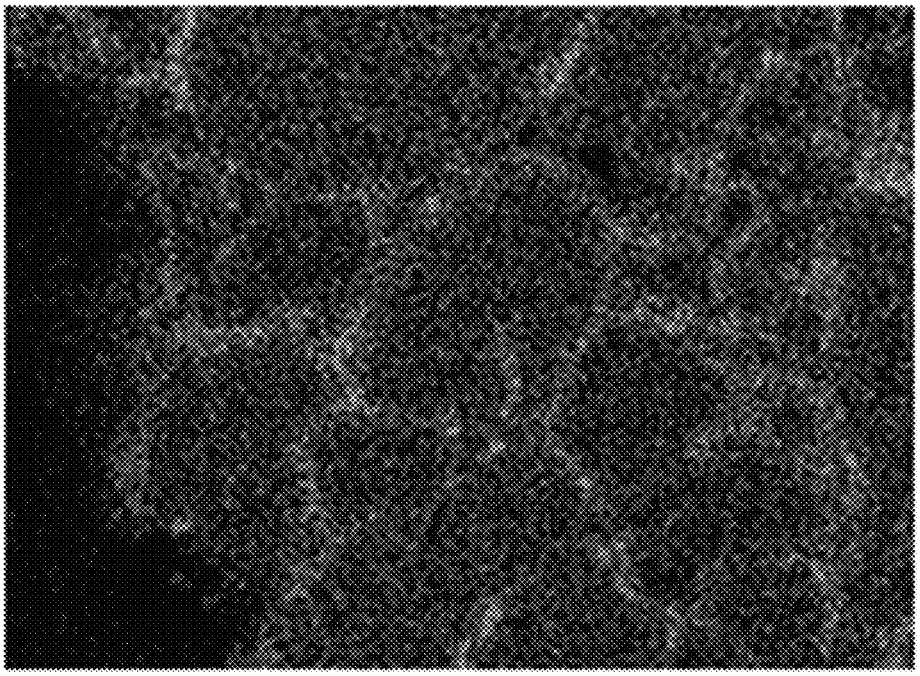
FIG. 10D is a mapping diagram showing the distribution of Al corresponding to the observation field of view of the SEM photograph of FIG. 10B.
Figure 10E:
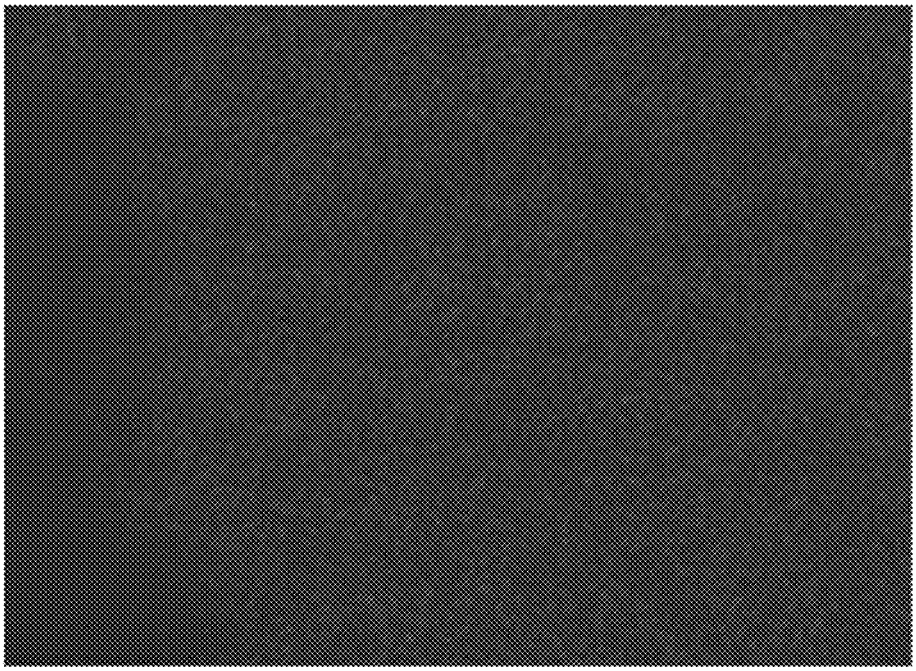
FIG. 10E is a mapping diagram showing the distribution of Cr corresponding to the observation field of view of the SEM photograph of FIG. 10B.
Figure 10F:
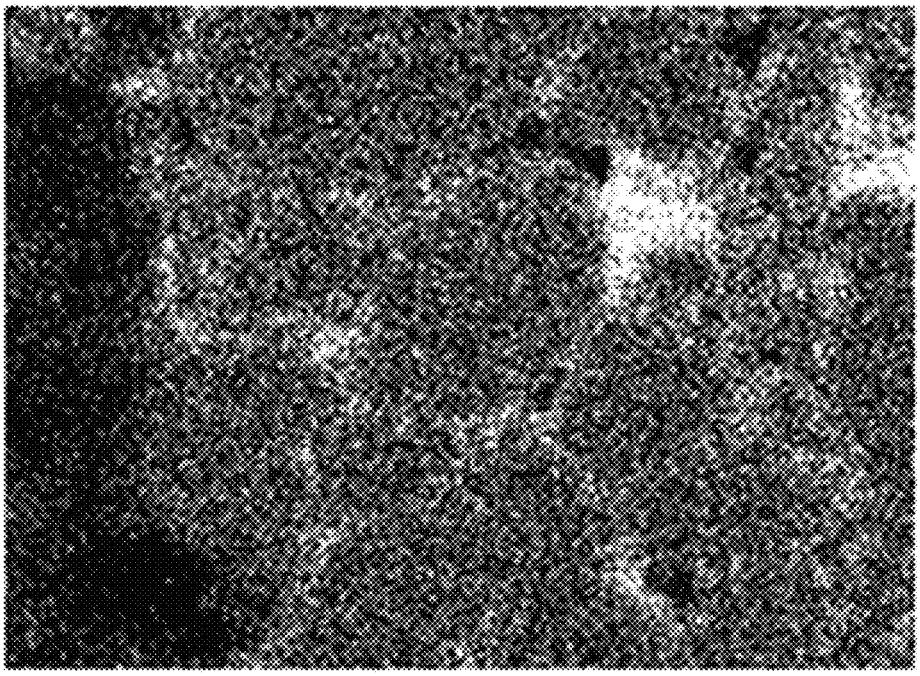
FIG. 10F is a mapping diagram showing the distribution of O corresponding to the observation field of view of the SEM photograph of FIG. 10B.

With respect to the magnetic core in Example, the cross section in the thickness direction including the processed surface of the magnetic core was observed and the distribution of each constituent element was investigated with a scanning electron microscope (SEM/EDX: Scanning Electron Microscope/energy dispersive X-ray spectroscopy). FIGS. 10A to 10F are SEM photographs of the cross section of the magnetic core, and mapping diagrams showing the element distribution in the corresponding visual field. FIG. 10A is an SEM photograph of the cross section of the magnetic core, FIG. 10B is an enlarged SEM photograph of the cross section of the magnetic core, FIG. 10C is a mapping diagram showing the distribution of Fe corresponding to the observation field of FIG. 10E, FIG. 10D is a mapping diagram showing the distribution of Al, FIG. 10E is a mapping diagram showing the distribution of Cr, and FIG. 10F is a mapping diagram showing the distribution of O. In each of the SEM photographs, a portion having high lightness represents the alloy particles of the soft magnetic material powder, and a portion having low lightness represents a grain boundary portion or a void portion. From FIG. 10A, it is found that a portion α in which the alloy particles are scraped off and a portion β having alloy particles falling off and being recessed from the processed surface are mixed in the processed surface.

In the mapping diagram, brighter color tone indicates more target elements. It is found that the concentration of Al on the surfaces of the alloy particles of the soft magnetic material powder is increased, and the amount of O is increased to form the oxide; and the alloy particles are bonded to form a layered oxide as a grain boundary. That is, as shown in FIG. 10D, Al has a remarkably high concentration between the alloy particles of the soft magnetic material powder (grain boundary). From FIGS. 10C and 10E, it is found that the concentration of Fe at the grain boundary is lower than that in the inside of the alloy particles, and Cr does not have a large concentration distribution. From these, it was confirmed that the oxide phase containing an element constituting the soft magnetic material powder is formed at the grain boundary, and the oxide phase is an oxide having an Al ratio higher than that of the alloy. The oxide phase was also formed on the alloy particle on the surface of a magnetic body. It was also found that, prior to the heat treatment, the concentration distribution of each constituent element was not observed, and the oxide was formed by the heat treatment.

The corrosion resistance was evaluated by a salt spray test. The salt spray test was performed by exposing the magnetic core to a 5% NaCl aqueous solution under conditions at 35° C. for 24 hours based on JIS 22371 (2000). As a result of visual confirmation, the occurrence of red rust was not observed on the surface of the magnetic core in Example after the test, and the magnetic core exhibited good corrosion resistance.

DESCRIPTION OF REFERENCE SIGNS

1 Magnetic core
10 Shaft portion
20 Flange portion
27 Tapered portion
40 Coil
45*a*, 45*b* Coil end portion
50 pressing flaws
60 Terminal electrode
100 Green compact
101 Sliding contact surface
102 Pressure surface
200 Pressing die
201 Upper punch
202 Lower punch
205 Die

The invention claimed is:

1. A method for manufacturing a powder magnetic core having Fe-M based alloy particles, wherein M is an element selected from Al and Cr, bonded via an oxide phase in which the element M is concentrated, the method comprising:

a first step of mixing a binder with a magnetic material powder containing Fe-M based alloy particles, wherein M is an element selected from Al and Cr, wherein the alloy particles have an insulating layer thereon, and wherein the magnetic material in the magnetic material powder is a soft magnetic material;

a second step of filling a pressing die with a mixture obtained through the first step, subjecting the mixture to pressing to obtain a green compact, and slidingly demolding the green compact from the pressing die;

a third step of processing the green compact after the second step, wherein the third step of processing the green compact removes an expansion deformed matter of the alloy particles present in a region where pressing flaws are formed on a surface of the green compact during the slidingly demolding, wherein a portion in which the alloy particles are scraped off and a portion having alloy particles falling off and being recessed from a processed surface are mixed in the processed surface; and a fourth step of subjecting the green compact after the third step to a heat treatment to oxidize surfaces of the Fe-M based alloy particles, wherein M is an element selected from Al and Cr, so that the oxide phase is formed.

2. The method for manufacturing a powder magnetic core according to claim 1, wherein the Fe-M-based alloy is an Fe—Al-based alloy, and Al is concentrated in the oxide phase.

3. The method for manufacturing a powder magnetic core according to claim 2, wherein the Fe—Al-based alloy further contains Cr and a content of Al is greater than a content of Cr.

* * * * *